US005193361A

United States Patent [19]

Singh et al.

[11] Patent Number: 5,193,361

[45] Date of Patent: Mar. 16, 1993

[54] AGIBASKET WASHER WITH CENTRALLY LOCATED PREMIXING CHAMBER

[75] Inventors: Devinder Singh, St. Joseph; Sheryl L. Farrington, Lincoln Township, Berrien County; Kenneth B. Austin, Hartford, all of Mich.

[73] Assignee: Whirlpool Corporation, Benton Harbor, Mich.

[21] Appl. No.: 815,792

[22] Filed: Jan. 2, 1992

[51] Int. Cl.[5] ..... D06F 39/02

[52] U.S. Cl. ..... 68/17 A; 68/53

[58] Field of Search ..... 68/17 A, 23.5, 53, 184

[56] References Cited

U.S. PATENT DOCUMENTS

| | | | |
|---|---|---|---|
| 2,522,242 | 9/1950 | Wagner | 68/17 A X |
| 2,969,665 | 1/1961 | Saverio | 68/184 |
| 2,970,463 | 2/1961 | Johnston | 68/17 A |
| 3,413,827 | 12/1968 | Kochanek | 68/184 X |
| 3,557,579 | 1/1971 | Marshall | 68/23.5 |
| 3,867,821 | 2/1975 | Hurwitz | 68/184 |
| 3,943,736 | 3/1976 | Carin | 68/133 |
| 4,417,457 | 11/1983 | Brenner | 68/17 A |
| 4,483,161 | 11/1984 | Oida | 68/23.6 |
| 4,651,542 | 3/1987 | Kohsaka | 68/23 R |
| 4,711,105 | 12/1987 | Oida et al. | 68/23.2 |
| 4,835,994 | 6/1989 | Ishida et al. | 68/174 |
| 4,987,627 | 1/1991 | Cur et al. | 8/158 |

*Primary Examiner*—Philip R. Coe

*Attorney, Agent, or Firm*—Stephen D. Krefman; Thomas J. Roth; Thomas E. Turcotte

[57] ABSTRACT

An apparatus for laundering a textile wash load that includes an imperforate wash tub having a sump at its lower end. A perforate wash basket that is adapted to receive a load of textile materials to be laundered is disposed concentrically within the wash tub. The wash basket includes an inner surface upon which are disposed a plurality of agitator vanes. A fluid conducting tower is disposed along the central longitudinal axis of the wash basket. The tower includes a nozzle assembly that is adapted to spray liquid onto the wash load. The tower also includes a mixing tank that receives wash additive.

14 Claims, 3 Drawing Sheets

AGIBASKET WASHER WITH CENTRALLY LOCATED PREMIXING CHAMBER

TECHNICAL FIELD

The present invention relates to an apparatus for washing textile articles, particularly articles of clothing, and specifically relates to an apparatus for washing textile articles without the use of a central agitator.

BACKGROUND OF THE INVENTION

Known washing machines use various methods for washing clothes loads but, in general, all methods utilize varying amounts of mechanical, chemical, and thermal energy to remove soil from the fabric of the clothing. Many machines employ an agitator that is mounted on a vertical axis and driven in an oscillatory fashion to agitate the clothes load in the presence of detergent solution. After a predetermined period of agitation, the wash cycle is typically followed by a rinse cycle. The central agitators of known washing machines are often provided with chambers on reservoirs into which wash additives may be introduced. The wash additives are then, at the appropriate times, dispensed into the wash load.

Although most modern washing machines use centrally located agitators, it has also been known in the part to provide alternative agitating arrangements, often in the form of fins on the side of a wash basket or wash tub. U.S. Pat. Nos. 1,634,238 to Sinclair, 2,516,655 to Smith, and 2,930,216 to Cazzaniga are exemplary of such arrangements.

The above-described washing machines present several disadvantages. For example, central-agitator washing machines tend to exhibit a high degree of mechanical abrasion of clothes. Furthermore, the mechanical action produced by central-agitators often results in tangling of the clothes.

Known washing machines lacking central-agitators present their own disadvantages. Such machines fail to provide any automatic mechanism for dispensing wash additives, and lack effective mechanisms for introducing wash fluids into the wash load.

SUMMARY OF THE INVENTION

It is, therefore, an object of the present invention to provide an apparatus for washing clothing articles that reduces mechanical abrasion and tangling of the clothes.

It is another object of the invention to provide an apparatus for washing clothes that includes an effective mechanism for introducing wash fluids, and for dispensing wash additives into the wash load.

These and other objects are achieved by the present invention by providing an apparatus for laundering a textile wash load that includes an imperforate wash tub having a sump at its lower end. A perforate wash basket that is adapted to receive a load of textile materials to be laundered is disposed concentrically within the wash tub. The wash basket includes an inner surface upon which are disposed a plurality of agitator vanes.

A fluid conducting tower is disposed along the central longitudinal axis of the wash basket. The tower includes a nozzle assembly that is adapted to spray liquid onto the wash load. The tower also includes a mixing tank that receives wash additive. The mixing tank has an outlet that opens into the sump of the wash tub.

A drive mechanism is connected to the wash basket and to the tower, and is capable of selectively rotating or oscillating the wash basket and the tower.

The tower also includes a valve assembly that directs fluid either to the nozzle assembly or to the mixing tank. A fluid circulation arrangement including a pump is connected to the wash tub and the tower, and is operable to circulate liquid from the sump through the tower.

In an illustrative embodiment, the fluid circulation arrangement includes a sump outlet conduit connected between the sump and an inlet of the pump. A Y-conduit is connected to an outlet of the pump. The Y-conduit has a first leg connected with a drain, and a second leg connected with the tower. A valve is disposed in the Y-conduit to direct fluid through the respective legs of the Y-conduit.

Other objects and advantages of the present invention will be apparent upon reference to the accompanying description when taken in conjunction with the following drawings.

DESCRIPTION OF THE PREFERRED EMBODIMENT

Figure 1:
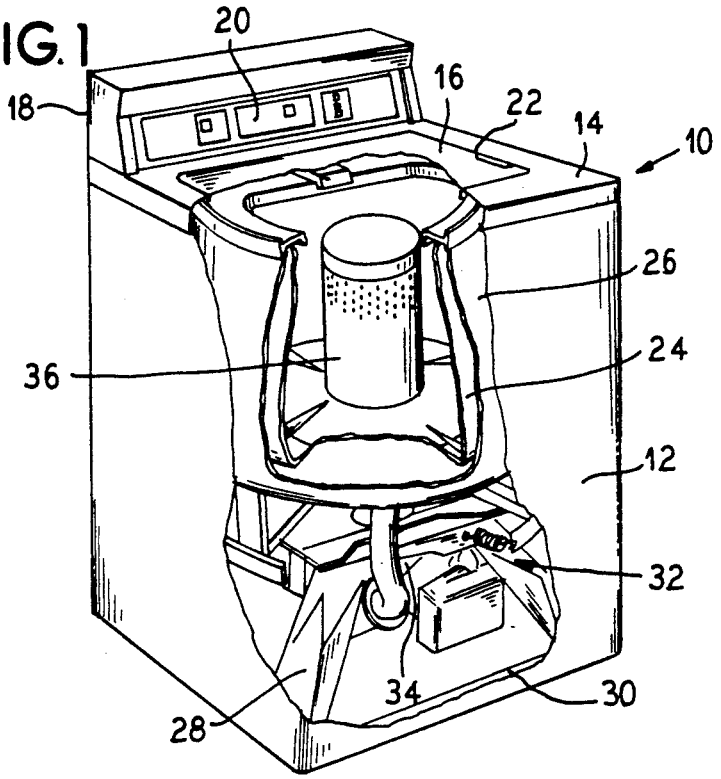
FIG. 1 illustrates a perspective view, partially broken away, of a washing machine embodying the principles of the present invention.

FIG. 1 illustrates an automatic washing machine generally at 10 having an exterior cabinet 12 with a top cabinet panel 14 and an openable lid 16. A control console 18 has a plurality of controls 20 to operate the washer through a series of washing, rinsing, and fluid extraction steps. The openable lid 16 provides access to a top opening 22 through which a load of clothes can be placed into a perforate basket 24 which is concentrically carried within an imperforate tub 26. The tub and basket form an assembly which is supported by a conventional suspension system, including a plurality of legs 28, which are secured to a bottom frame 20. A counter-balancing arrangement 32 is secured between the legs 28 and another portion of the suspension system. An electric motor 34 operates to drive the basket 24 in either a rotary or an oscillatory motion. A fluid conducting tower 36, which will be described in detail hereinbelow, is mounted along a central longitudinal axis of the basket 24.

Figure 2:
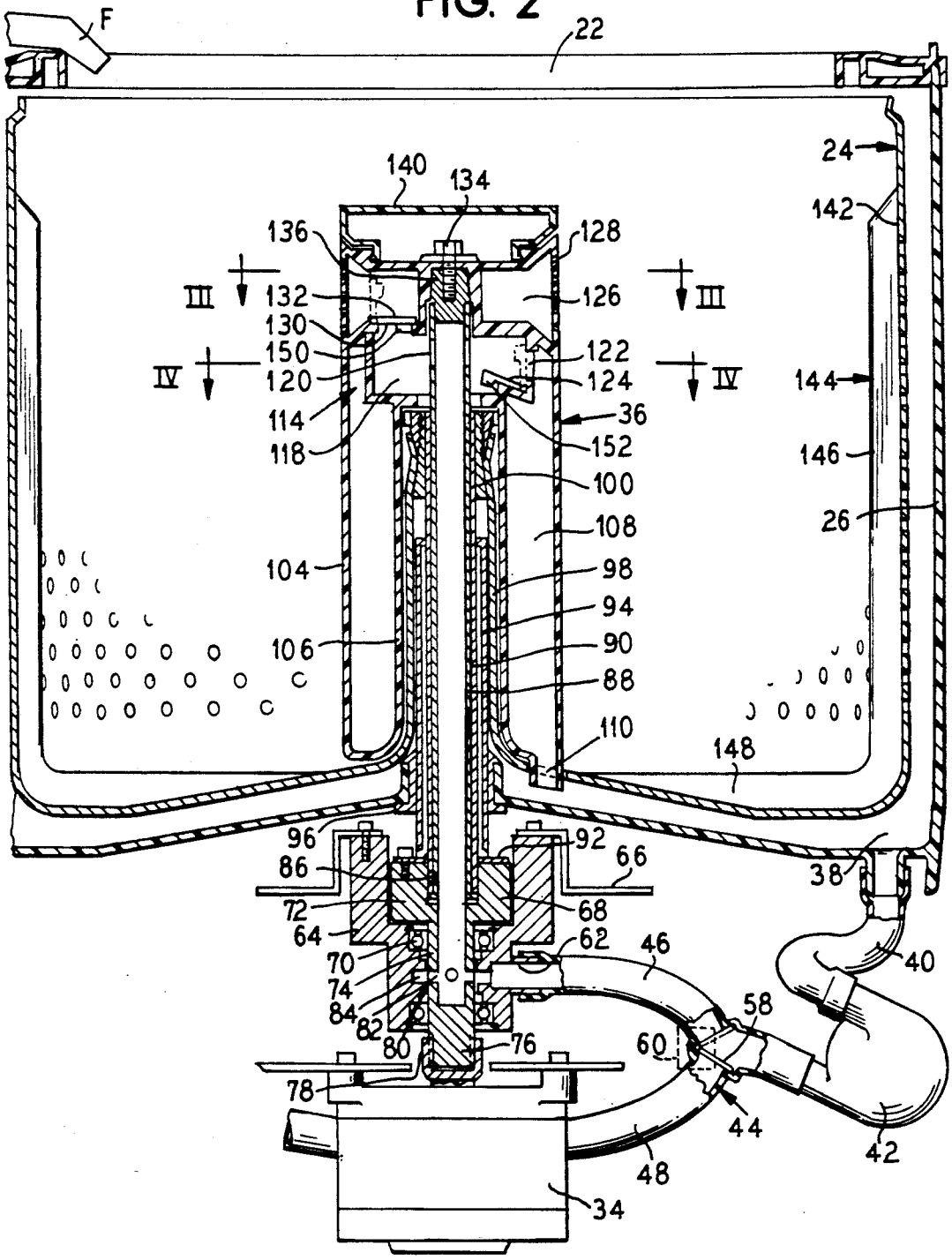
FIG. 2 is a detailed sectional view through the interior of the washing machine shown in FIG. 1.

FIG. 2 illustrates the interior of the washer 12 in greater detail. A sump 38 is positioned at the bottom of the wash tub 26, and connects the tub 26 to an outlet conduit 40. The outlet conduit 40 leads to a pump 42, which may be driven by the motor 34. Proceeding from the pump 42 is a conduit 44 which has a Y-connection with a first leg 46 and a second leg 48. In the Y-connection there is disposed a pivotable valve member 50 which is operated by a solenoid 56 to close either the first portion 46 or second portion 48. The second portion 48 extends to a drain for disposal of liquid. The first portion 46 is connected to an inlet fitting 62 on a support member 64. The support member 64 is stationarily secured to a support surface 66, and is adapted to receive a rotatable rotary hub 68. A bearing assembly 70 is disposed between the support member 64 and the rotary hub 68. The rotary hub 68 includes a flange portion 72 and a shaft portion 74. The shaft portion 74 terminates in a stub 76 that is adapted to be received in a coupling 78 in driving connection with the motor 34. The hub 68 may be connected directly to the motor 34, or a transmission mechanism (not shown) may be provided. The rotary hub 68 also includes a stepped central bore 80 and a plurality of radial inlets 82. The radial inlets 82 open into an annular inlet chamber 84 provided in the support member 64. The stepped bore 80 includes an upper, wider portion 86 from which extends a tower conduit 88 concentrically surrounded by an inner shaft 90. The inner shaft 90 is connected to the flange portion 72 of the rotary hub 68 with a retaining flange 92, and is surrounded by a shaft sleeve 94. The shaft sleeve 94 is stationary, and is connected to the tub 26 by a seal connection 96. The shaft sleeve 94 is concentrically surrounded by a cylindrical extension 98 of the wash basket 24. As illustrated in FIG. 2, the cylindrical extension 98 is disposed along a central longitudinal axis of the basket 24, and may be formed integrally therewith. The cylindrical extension 98 is connected for rotation with the inner shaft 90 via a threaded seal connection 100.

The cylindrical extension 98, the shaft sleeve 94, the inner shaft 90, and the conduit 88 are concentrically surrounded by the tower 36. The tower 36 includes a generally cylindrical outer wall 104 and a generally cylindrical inner wall 106. A mixing tank 108 is defined between the outer wall 104 and the inner wall 106. The mixing tank 108 includes, at its bottom, an outlet 110 that extends through the bottom of the basket 24. The upper end of the tower 36 includes a valve assembly 114, and a nozzle assembly 116. The valve assembly 114 includes an outlet chamber 118 in fluid communication with the conduit 88 via a plurality of radial outlets 120. The outlet chamber 118 includes a mixing chamber inlet 122 that is selectively closed by a mixing chamber valve 124.

The nozzle assembly 116 includes a nozzle chamber 126 and a plurality of outlets 128. A nozzle chamber inlet 130 is selectively closed by a nozzle chamber valve 132. A fastener 134 secures the nozzle assembly 116 to a plug 136 that serves to close the conduit 88. A removable cap 140 is secured to the top of the tower 36.

The basket 24 includes an inner surface 142 upon which are disposed a plurality of fins 144 each of the fins 144 includes a vertical portion 146 and a horizontal portion 148.

In the illustrated embodiment, the nozzle chamber inlet valve 132 is provided with a counter-weight 150 to bias the valve 132 to a closed position. The mixing chamber inlet valve 124 is provided with a counter-weight 152 to biased the valve 124 to an open position. Although the illustrated embodiment shows the valves bias to their relative closed and opened positions by the force of gravity acting on counter-weights, it is also contemplated that the valves could be biased to these positions by any suitable means, for example by spring biasing.

Figure 3:
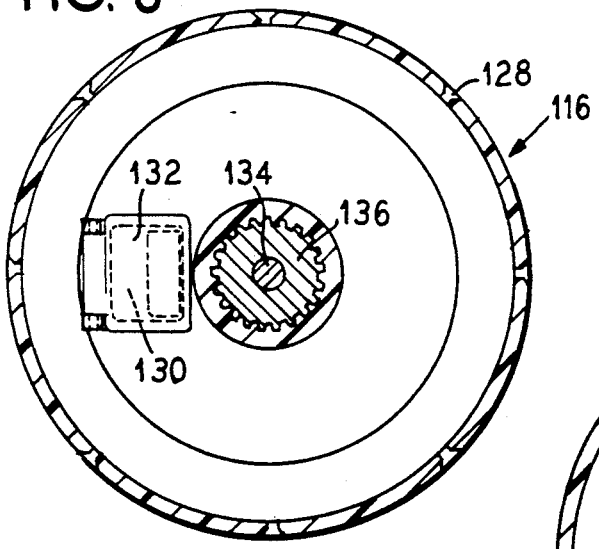
FIG. 3 is a sectional view taken generally along lines III—III of FIG. 2.

FIG. 3 is taken generally along lines III—III of FIG. 2, and shows the valve 132 biased downwardly by the counter-weight 150 to close the nozzle chamber inlet 130.

Figure 4:
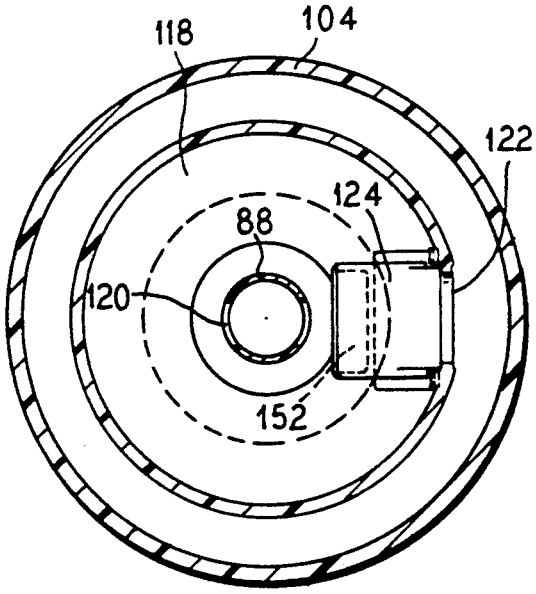
FIG. 4 is a sectional view taken generally along lines IV—IV of FIG. 2.

FIG. 4, taken generally along lines IV—IV of FIG. 2, illustrates the mixing chamber valve 124 biased downwardly by the weight of counter-weight 152 to open the mixing chamber inlet 122.

Operation of the washing machine 10 embodying the principles of the present invention is as follows. First, textiles to be laundered are introduced through the top opening 22 into the basket 24, and an appropriate amount of laundry detergent is added. The lid 16 is then closed, and the user operates the controls 20 on the console 18 so as to select the desired wash cycle, fabric type, water temperature, and other load and cycle parameters. An automatic wash cycle then begins with the introduction of wash water from a fill nozzle F. Flow of water from the nozzle F is shut-off after the appropriate predetermined amount of water has been introduced into the wash tub, either using a time cycle, level sensor, or other conventional fill controls.

Next, the solenoid 60 is actuated to bring the pivotable valve 58 into the position shown in solid lines in FIG. 2, opening the leg 46 of the Y-conduit 44. The pump 42 is then actuated to pump water and detergent from the tub via the sump 38, through the outlet conduit 40, the leg 46, and the conduit 88. Water exits the conduit 88 via the radial outlets 120, and passes through the outlet chamber 118 and the mixing chamber inlet 122 into the mixing tank 108, where it mixes with detergent that has been placed there previously. The mixed water and detergent exits the mixing tank 108 through the outlet 110 into the sump 38 of the tub 26, where it is recirculated by the pump 42 until the water and detergent are thoroughly mixed.

After the water and detergent form a thoroughly mixed solution, the pump 42 continues to operate, and the motor 34 is actuated to rotate the basket 24 and the tower 36. When the basket 24 and tower 36 reach a predetermined rotational speed, centrifugal force causes the mixing chamber inlet valve 122 and the nozzle chamber inlet valve 130 to move into the position shown in dotted line in FIG. 2. In this position, the mixing chamber valve 124 prevents wash solution exiting the radial outlets 120 from entering the mixing tank 108. Instead, the wash solution enters the nozzle chamber 126 through the nozzle chamber inlet 130, and is sprayed onto the wash load through the nozzle outlets 128. Rotation and recirculation continues until the wash load is thoroughly wetted with the wash solution, at which time the pump 42 is shut-off, and the motor 34 is actuated to oscillate, rather than rotate, the basket 24. Oscillation of the basket 24 produces an agitating action between the clothes load and the fins 144, thus providing a mechanical cleaning action. the length of time of agitation is dependent upon the cycle selected by the user and, optionally, the amount of fabric within the basket 24.

Upon termination of the agitation step, the motor 34 is stopped, and the solenoid 60 is actuated to bring the pivotable valve 58 into the position shown in dotted lines in FIG. 2. The pump 42 is then actuated to pump soiled wash solution from the sump 38 through the outlet conduit 40 and the leg 48 to drain.

After the soiled wash solution has been pumped out of the tub 26, the solenoid 60 is actuated to open the leg 46 of the Y-conduit 44, and rinse water is introduced into the tub 26 through the fill nozzle F. The level of rinse water is controlled in the same manner as the level of wash water. The pump 42 is actuated to begin circulating rinse water from the tub 26 through the conduit 88, and the motor 34 is actuated to begin rotation of the basket 24, thus allowing rinse water to pass through the nozzle assembly 116 and onto the wash load. The rinse step can be continued, or stopped, drained, and repeated, as necessary to remove all of the wash solution residue from the wash load.

Upon termination of the rinsing step, the motor 34 is again stopped, and the tub 26 is drained of rinse water in a manner similar to that described with respect to draining of wash solution. Once the rinse water has been drained from the tub 26, the motor 34 may be actuated to rotate the basket 24 while the pump 42 continues to operate, so as to pump as much of the liquid as possible from the clothes load directly to the drain. Of course, it is contemplated that, depending upon the cycle selected by the user, any of the above steps may be repeated as many times as may be deemed necessary.

Figure 5:
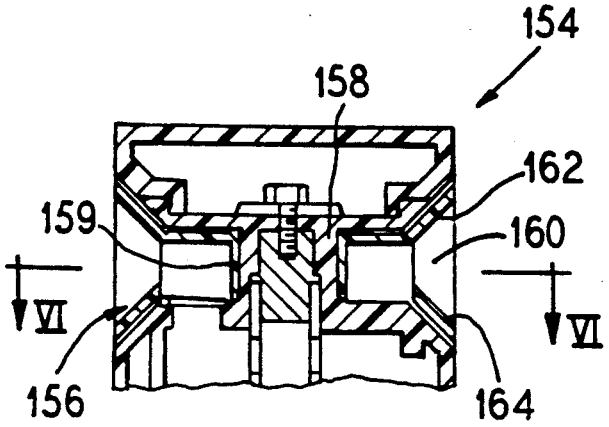
FIG. 5 is a sectional view of an alternative nozzle arrangement.
Figure 6:
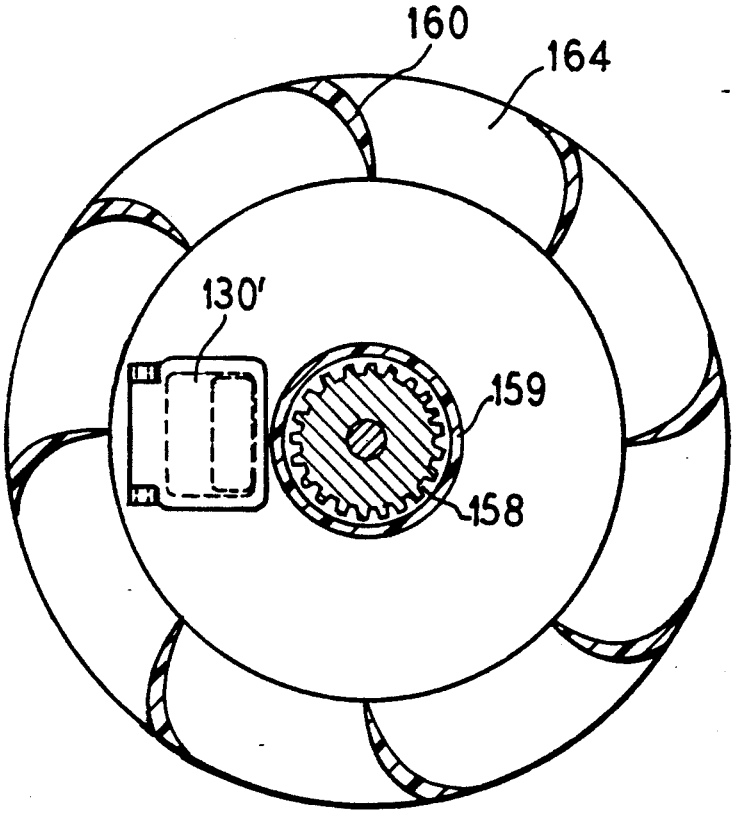
FIG. 6 is a sectional view taken generally along lines VI—VI of FIG. 5.

FIGS. 5 and 6 illustrate an alternative embodiment of the nozzle assembly 116. Except as indicated, the parts are similar to those discussed with reference to FIGS. 1 through 4.

FIGS. 5 and 6 illustrate a rotary nozzle assembly 154 including a rotatable nozzle member 156 mounted for rotation on a spindle 158. The nozzle member 156 includes a nozzle hub 159 upon which a plurality of deflectors 160 are supported by an upper ring 162 and a lower ring 164.

As can be seen in FIG. 6, the lower ring 164 provides enough clearance within the nozzle assembly 154 for the nozzle chamber inlet valve 130' to open.

In operation, water under pressure enters the nozzle chamber, and strikes the arcuate deflectors 160, thus causing the nozzle member 156 to rotate. Rotation of the nozzle member 156 affects an even distribution of liquid onto the wash load. Although the illustrated embodiment shows that the nozzle member 156 is rotated by the force of water striking the deflectors 160, it is also contemplated that the nozzle member could be configured so that pressure of the water alone would cause rotation, as in a reaction motor discharge nozzle.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An apparatus for laundering a textile wash load, said apparatus comprising:

a perforate wash basket adapted to receive a wash load of textile materials to be laundered;

at least one vane disposed on an interior surface of said wash basket; and a fluid-conducting tower fixed relative to said basket and disposed generally along a central longitudinal axis of said wash basket;

wherein said tower comprises:

a nozzle assembly adapted to spray liquid into said wash basket;

a mixing tank adapted to receive and hold a wash additive; and a valve assembly disposed in said tower;

wherein said valve assembly comprises:

a first valve adapted to selectively control flow of fluid into said mixing tank; and a second valve adapted to selectively control flow of fluid into said nozzle assembly.

2. An apparatus according to claim 1, wherein said first and second valves comprise centrifugally actuable valve members including biasing arrangements.

3. An apparatus according to claim 2, wherein said biasing arrangements of said first and second valves comprise counterweights.

4. An apparatus for laundering a textile wash load, said apparatus comprising:

an imperforate wash tub including a sump disposed at a lower end thereof;

a perforate wash basket adapted to receive a load of textile materials to be laundered, said wash basket being disposed concentrically within said wash tub and including an inner surface upon which are disposed a plurality of vanes;

a fluid conducting tower disposed within, and along a central longitudinal axis of, said wash basket, said tower including a nozzle assembly adapted to spray liquid into said wash basket and a mixing tank adapted to receive wash additive, said mixing tank having an outlet opening adjacent said sump;

drive means, operatively connected to said wash basket and to said tower, for selectively rotating or oscillating said wash basket and said tower;

a valve assembly disposed on said tower, said valve assembly being adapted to selectively direct fluid either to said nozzle assembly or into said mixing tank; and a fluid circulation assembly including a pump connected to said wash tub and said tower, said pump being operable to circulate liquid from said sump through said tower.

5. An apparatus according to claim 4, wherein said fluid circulation assembly further comprises the following:

a sump outlet conduit connected between said sump and an inlet of said pump;

a Y-conduit connected to an outlet of said pump, said Y-conduit including a first leg connected in selective fluid communication with a drain, and a second leg connected in selective fluid communication with said tower; and a valve in said Y-conduit, said valve being actuable to a first position opening said first leg and closing said second leg, and to a second position opening said second leg and closing said first leg.

6. An apparatus according to claim 4, wherein said tower further comprises:

a generally cylindrical outer wall; and a generally cylindrical inner wall substantially concentrically surrounded by, and connected to, said outer wall, said mixing tank being defined between said inner and outer walls.

7. An apparatus according to claim 6, wherein said vane assembly comprises an outlet chamber disposed adjacent an upper surface of said inner wall of said tower.

8. An apparatus according to claim 7, wherein said outlet chamber of said valve assembly comprises:

a nozzle chamber inlet in selective fluid communication with said nozzle assembly;

a nozzle chamber inlet valve adapted to selectively open and close said nozzle chamber inlet;

a mixing tank inlet in selective fluid communication with said mixing tank; and a mixing tank valve adapted to selectively open and close said mixing tank inlet.

9. An apparatus according to claim 7, wherein said fluid circulation assembly further comprises the following:

a sump outlet conduit connected between said sump and an inlet of said pump;

a Y-conduit connected to an outlet of said pump, said Y-conduit including a first leg connected in selective fluid communication with a drain, and a second leg connected in selective fluid communication with said tower; and a valve in said Y-conduit, said valve being actuable to a first position opening said first leg and closing said second leg, and to a second position opening said second leg and closing said first leg.

10. An apparatus according to claim 9, further comprising:

a support member including an inlet fitting connected to said second leg of said Y-conduit and leading to an annular inlet chamber, said support member being stationarily secured to a support surface of said apparatus;

a rotary hub received for rotation in said support member, said rotary hub including shaft portion terminating in a stub coupled to said drive means, and a stepped central bore, with a plurality of radial inlets opening from said central bore into said annular inlet chamber of said support member; and a tower conduit extending from said central bore of said rotary hub to said outlet chamber of said nozzle assembly, said tower conduit including a plurality of radial outlets opening into said outlet chamber.

11. An apparatus according to claim 10, further comprising:

a cylindrical extension of said wash basket extending generally concentrically within said inner wall of said tower;

an inner shaft concentrically surrounding, and connected for movement with, said tower conduit; and a seal connection securing said cylindrical extension of said wash basket to said inner shaft.

12. An apparatus according to claim 11, further comprising a shaft sleeve disposed generally concentrically between said cylindrical extension of said wash basket and said inner shaft.

13. An apparatus according to claim 4, wherein said nozzle assembly comprises a rotary discharge nozzle.

14. An apparatus according to claim 4, wherein said mixing tank outlet extends through a bottom of said wash basket.

* * * * *